US012180812B2

(12) United States Patent
López Robayo

(10) Patent No.: US 12,180,812 B2
(45) Date of Patent: Dec. 31, 2024

(54) MODIFIED JET PUMP INCORPORATING A SUPPORT FOR MPLT LOGGING AT THE BOTTOM OF AN OIL WELL

(71) Applicant: Byron Raul López Robayo, Quito (EC)

(72) Inventor: Byron Raul López Robayo, Quito (EC)

( * ) Notice: Subject to any disclaimer, the term of this patent is extended or adjusted under 35 U.S.C. 154(b) by 95 days.

(21) Appl. No.: 18/007,011

(22) PCT Filed: Jul. 26, 2021

(86) PCT No.: PCT/IB2021/056777

§ 371 (c)(1),
(2) Date: Jan. 26, 2023

(87) PCT Pub. No.: WO2022/023957

PCT Pub. Date: Feb. 3, 2022

(65) Prior Publication Data

US 2024/0011389 A1 Jan. 11, 2024

(51) Int. Cl.

| | |
|---|---|
| ***E21B 43/12*** | (2006.01) |
| ***E21B 49/00*** | (2006.01) |
| ***F04F 5/44*** | (2006.01) |

(52) U.S. Cl.

CPC ..... *E21B 43/124* (2013.01); *E21B 49/00* (2013.01); *F04F 5/44* (2013.01)

(58) Field of Classification Search

CPC . F04F 5/00–5/54; E21B 47/01; E21B 43/124; E21B 49/00

See application file for complete search history.

(56) References Cited

U.S. PATENT DOCUMENTS

2004/0223853 A1 11/2004 Khomynets et al.
2005/0053473 A1* 3/2005 Khomynets ..... E21B 47/00 417/172
2009/0016900 A1* 1/2009 Khomynets ..... E21B 43/129 417/172
2010/0243256 A1 9/2010 Khomynets
2012/0273221 A1* 11/2012 Robayo ..... E21B 43/124 166/372

FOREIGN PATENT DOCUMENTS

MX 2011006676 A 10/2012

OTHER PUBLICATIONS

International Search Report w translation_PCT/IB2021/056777_ Feb. 3, 2022_7 pages.

* cited by examiner

*Primary Examiner* — Bryan M Lettman
(74) *Attorney, Agent, or Firm* — Kilpatrick Townsend & Stockton LLP

(57) ABSTRACT

A jet pump for oil production involving extraction by hydraulic lift and consists of a jet pump integrally redesigned so that it is traversed by a cable for the control of the recorders of the production variables of the oil well. This control can be performed from the surface, enabling the collection of data related to measurements such as pressure, temperature and flow, both in static conditions of the well, i.e. when the well is not pumping, and in dynamic conditions, i.e. when the well is in production, and also have the security of the recovery of recorded data and measurement tools, known by its acronym MPLT (Memory Production Logging Tools), to determine the productive status of the well and make timely decisions in the management and administration of the same.

20 Claims, 6 Drawing Sheets

Figure 1A:
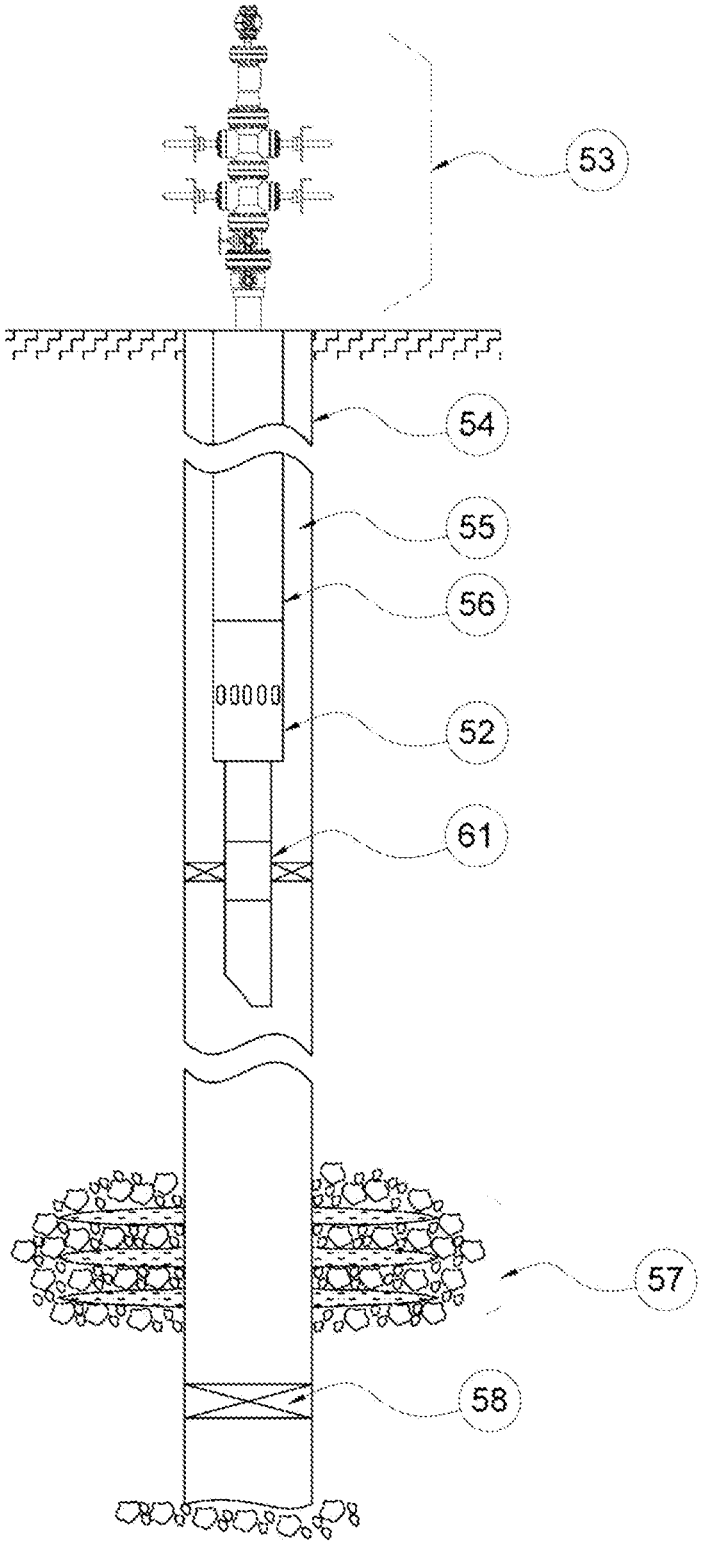

MODIFIED JET PUMP INCORPORATING A SUPPORT FOR MPLT LOGGING AT THE BOTTOM OF AN OIL WELL

CROSS REFERENCE TO RELATED APPLICATIONS

This application is a U.S. national phase of International Patent Application No. PCT/IB2021/056777 filed on Jul. 26, 2021, which claims priority to Ecuadorian Patent Application No. SENADI-2020-44054 filed on Jul. 27, 2020, the entire contents of which are hereby incorporated herein by this reference.

1. FIELD OF THE INVENTION

The present invention relates to a modified downhole jet pump assembly, which is coupled with a support assembly in which logging instruments are incorporated to be mobilized deep in the wellbore in production zones to obtain data on well conditions, such as pressure, temperature and flow values at different levels within the wellbore, by driving the logger string from the surface through the wireline. Logging with this modified jet-pump assembly is performed both when the well is producing and when it is static.

2. BACKGROUND AND SUMMARY OF THE INVENTION

In the technique, both in non-patent and patent literature, the importance of adequate monitoring of the conditions and status of oil wells is found, which affects, especially in financial terms in production, as well as in terms of environmental safety and adequate production properties, for an updated and adequate management of the well during production. The monitoring is done with a Memory Production Logging Tool, known in the oil industry as MPLT (Memory Production Logging Tool).

There are some proposals for data collection mechanisms that have traditionally been applicable to the electric pumping system; in the hydraulic pumping system, at the moment there are solutions that allow this task to be carried out, but they present inconveniences at the time of operation due to problems during the handling of the steel cable, which frequently causes serious incidents that affect production, causing production stoppages for many hours.

The state of the technique includes patent US 20170370195, which describes a reverse downhole jet pump that incorporates a steel cable that, passing through a lateral space of its main internal elements, supports a string of recorders in its lower part, which can be manipulated from the surface. The above-mentioned patent constitutes the state of the technique closest to the development of the present invention; however, in the present invention different and substantial aspects are analyzed with respect to the answer given to the same problem that still exists, in relation to the search for a process that allows obtaining measurement records through the drive of a steel cable that crosses the downhole jet pump, and which ends in an element that is coupled at its lower end to a device that houses the cardboard with the string of recorders to be driven from the surface, ensuring an operation free of adverse eventualities such as those mentioned above, which are present in the state of the technique. This implies the development of a new downhole jet pump, which allows the steel cable to pass through the center and in a coaxial manner, unlike the previous one, where the steel cable travels along one side of the inner elements of the downhole jet pump, requiring to be guided by placing support elements at several non-aligned points, which results in the cable being forced at those points when it is driven from the surface for the execution of the parameter logging works; the efforts resulting from these actions end up wearing out the support points of the steel cable and deforming it at the inflection points.

The downhole jet pump of this invention is the result of a modification and integral rearrangement of the internal elements of the downhole jet pump currently in use, with the purpose of incorporating in its longitudinal axis a free space, through which a steel cable runs longitudinally and axially centered with respect to the pump body and the circulation jacket, which in its lower part adjusts a support element for the board containing the string of recorders to be manipulated from the surface at different depths inside the well, allowing measurements to be made safely, such as: pressure, temperature and flow rates when required, both statically, i.e. with the downhole jet pump without lifting oil, and dynamically, i.e. with the downhole jet pump in production. These activities also require the incorporation of new elements to increase its operating efficiency, including modifications to the shut-off valve, incorporation of solids filters, redesign of the discharge and suction flow path and incorporation of a bypass valve in this path; the purpose of the shut-off valve is to isolate the hydrostatic pressure above the downhole jet pump to obtain only the reservoir pressure without the need to extract the pump. With these new features, the redesign complies with the required characteristics to provide a solution to the problem posed and ensure the final results with savings in time and resources.

The new design of the downhole jet pump of the present invention incorporates the following changes with respect to the conventional downhole jet pump, which allow the safe actuation of the bypass and shut-off valves with the incorporated modifications, in addition to obtaining the necessary space to freely cross the steel cable that supports and allows driving the recorder string, which, as indicated, has only two supports: one on the upper part, placed on the fishing neck by means of a cable sealing system which also constitutes the main cable guiding point inside the downhole jet pump of the present invention, and a support at the lower end of the same; in other words, since there are no elements in the steel cable path inside the pump that could affect its integrity or its operation, it is not necessary to cause deviations in its path for its safe operation. In addition, unlike the state of the art, this ensures that the cable is not subject to kinks, which also prevents it from being subjected to damaging stresses that cause frictional stresses that cause the sealing systems in the supports to wear out in less time, and even that the steel cable may break or become entangled when it is pulled from the surface during the maneuvers of introducing and settling the pump, obtaining the logs and extracting the downhole jet pump and the string of loggers.

To achieve these changes, the downhole jet pump has been completely redesigned since the main internal components of the pump have had to be redistributed, including the elements where the Venturi effect is generated, i.e. the nozzle and the nozzle with their respective accessories, as well as the fluid suction and discharge systems, which have been improved to achieve a laminar flow that increases its efficiency by eliminating the turbulence caused by the fluids. A debypass valve has also been incorporated, a new type of shut-off valve suitable for the invention that allows the cable to pass through it, unlike the state of the technique, which uses a ball valve where it is not possible to achieve this objective, and a solid filtering system that protects the functionality of the shut-off valve and the Venturi system. In this way, it is possible to optimize the operations required for the coupling and use of the string of recorders.

Another advantage of the new design is a built-in davit at the bottom for capturing the fishing head of the logging tool string, also not foreseen in the state of the technique, which ensures reliable and safe retrieval of the assembly to the surface.

3. BRIEF DESCRIPTION OF THE FIGURES

FIG. 1*a* is a typical representation of the mechanical completion of an oil well, showing the wellhead (53), well casing (54), production tubing (56), annular space (55), sliding sleeve (52), tubing packing (61), bottom plug (58) and the reservoir productive sands zone (57).

Figure 1B:
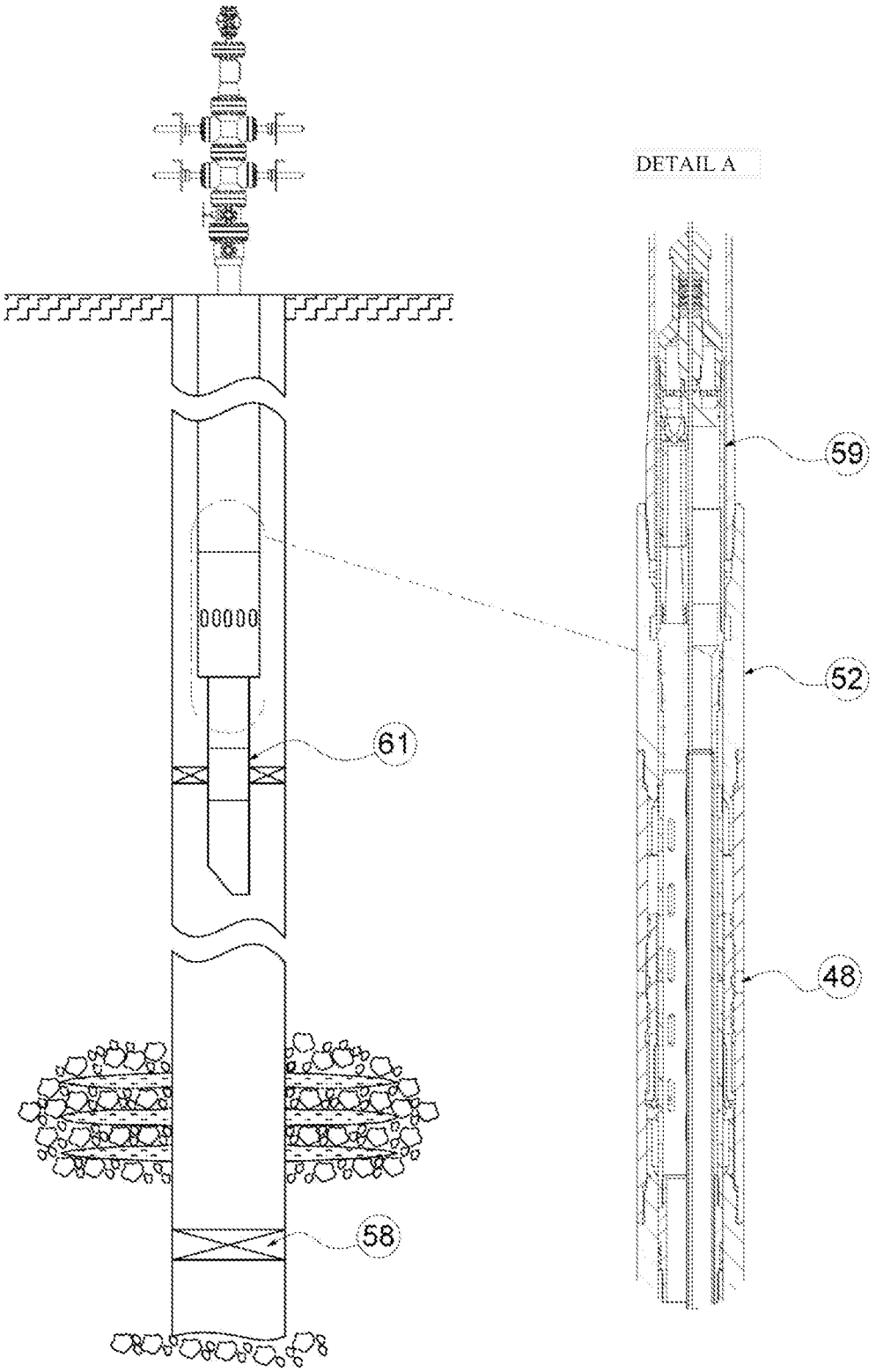

FIG. 1*b*, similar to FIG. 1*a*, which also shows the sliding sleeve (52), inside which the modified downhole jet pump (59) and the circulation ports of the sliding sleeve are located.

Figure 2:
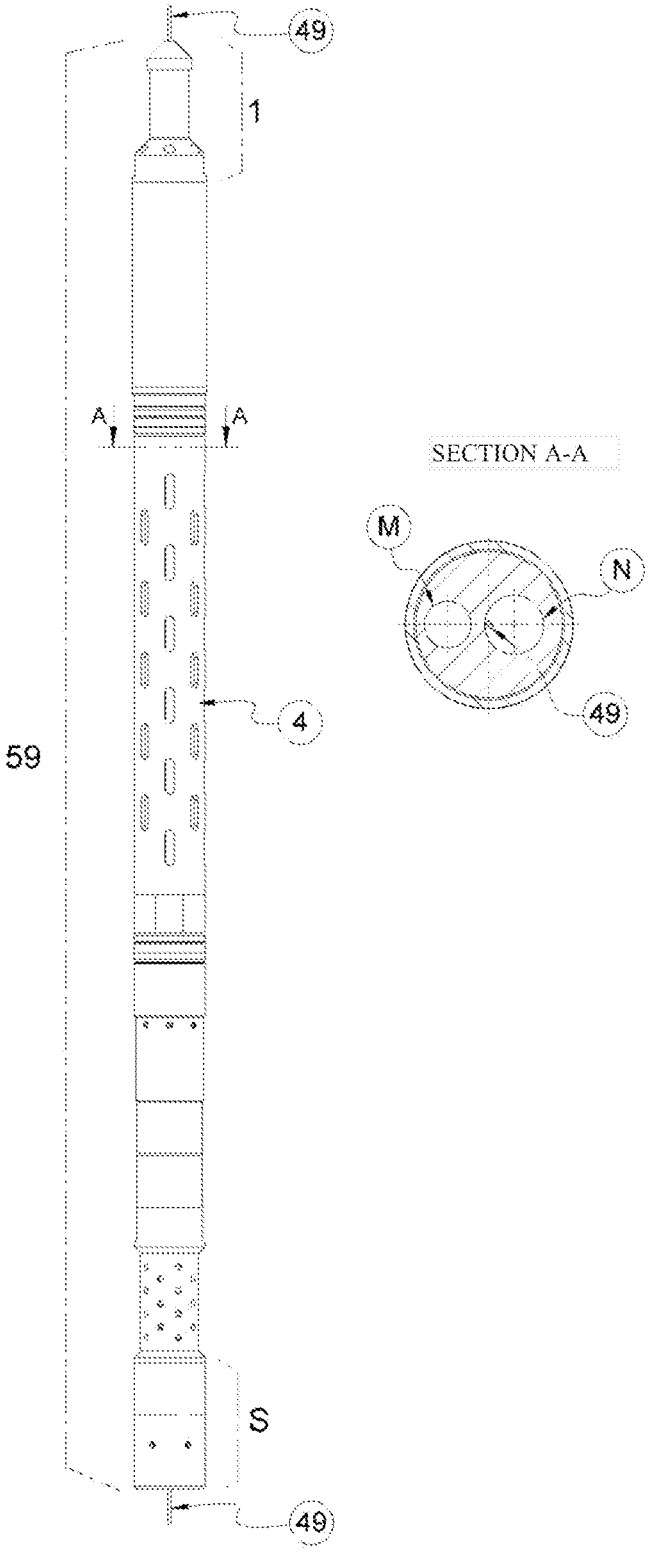

FIG. 2 shows a schematic representation of the downhole jet pump of this invention, and a cross section A-A at the discharge connector (FIG. 3.3) showing the flow areas of the production fluids with the literal N and discharge with the literal M, which have been completely redesigned. Number 49 shows the steel cable that runs concentrically through the downhole jet pump; number 4 shows the discharge pipe of the fluids produced from the downhole jet pump to the sliding sleeve and annular space. At the top of the pump, section 1 of the fishing collar is displayed, and at the bottom of the downhole jet pump, section S is displayed, which consists of a built-in davit for capturing the fishing head of the logging tool string.

Figure 3:
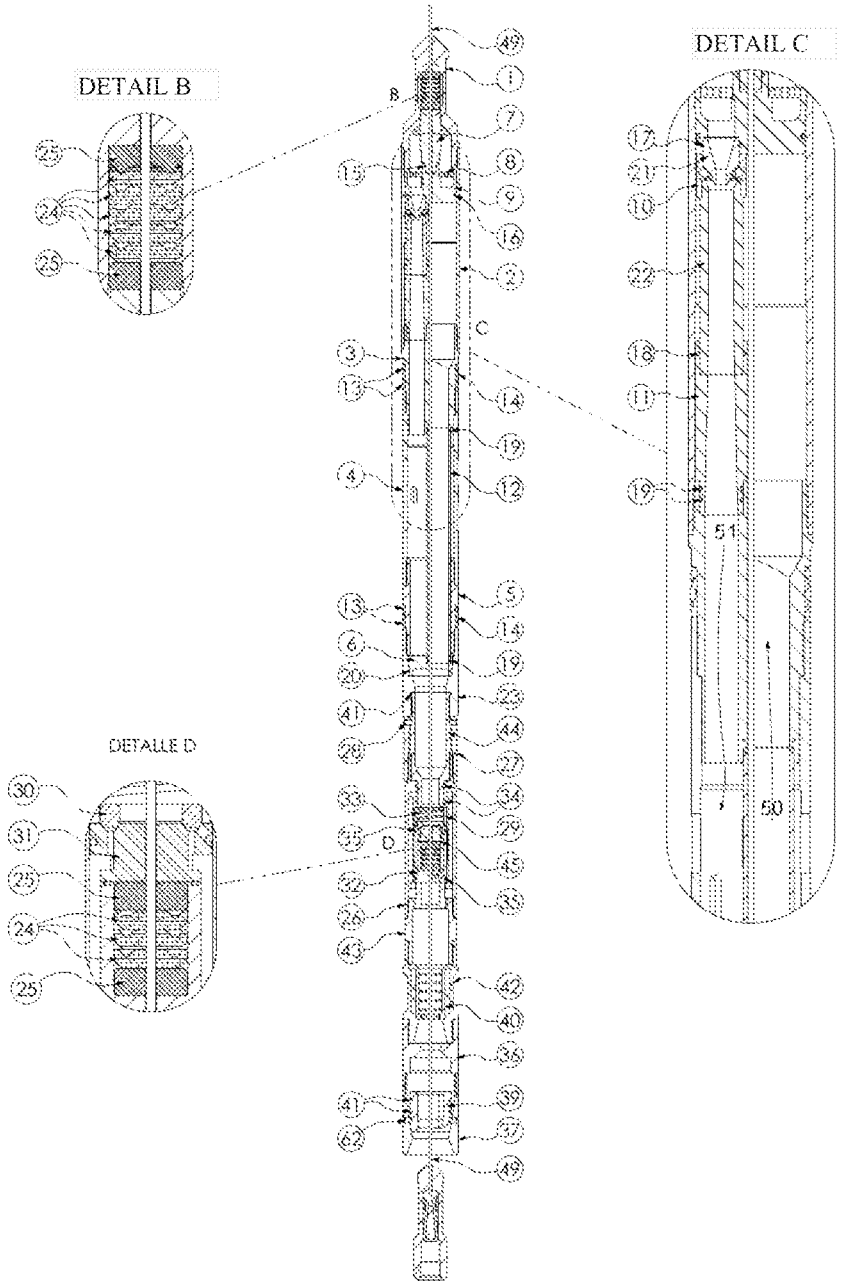

FIG. 3 depicts the modified downhole jet pump assembly in longitudinal section, showing its internal parts; included are details of the seal assemblies of the steel cable passage (49) through the upper section (detail B) and through the lower section (detail D); and, in detail C, an enlargement of the main internal elements of the downhole jet pump that allows us to visualize the suction (50) and discharge (51) routes followed by the production fluid, as well as the integral parts of the Venturi system, which are: Nozzle (21), nozzle housing (9), nozzle retainer (10), diffuser (11) and throat (22). Also noted: upper filter (8), upper seal assembly retainer (7), lower seal assembly guard (32), discharge tube (4) and suction tube (12). Other parts are described under the heading "Detailed Description of the Invention".

Figure 4:
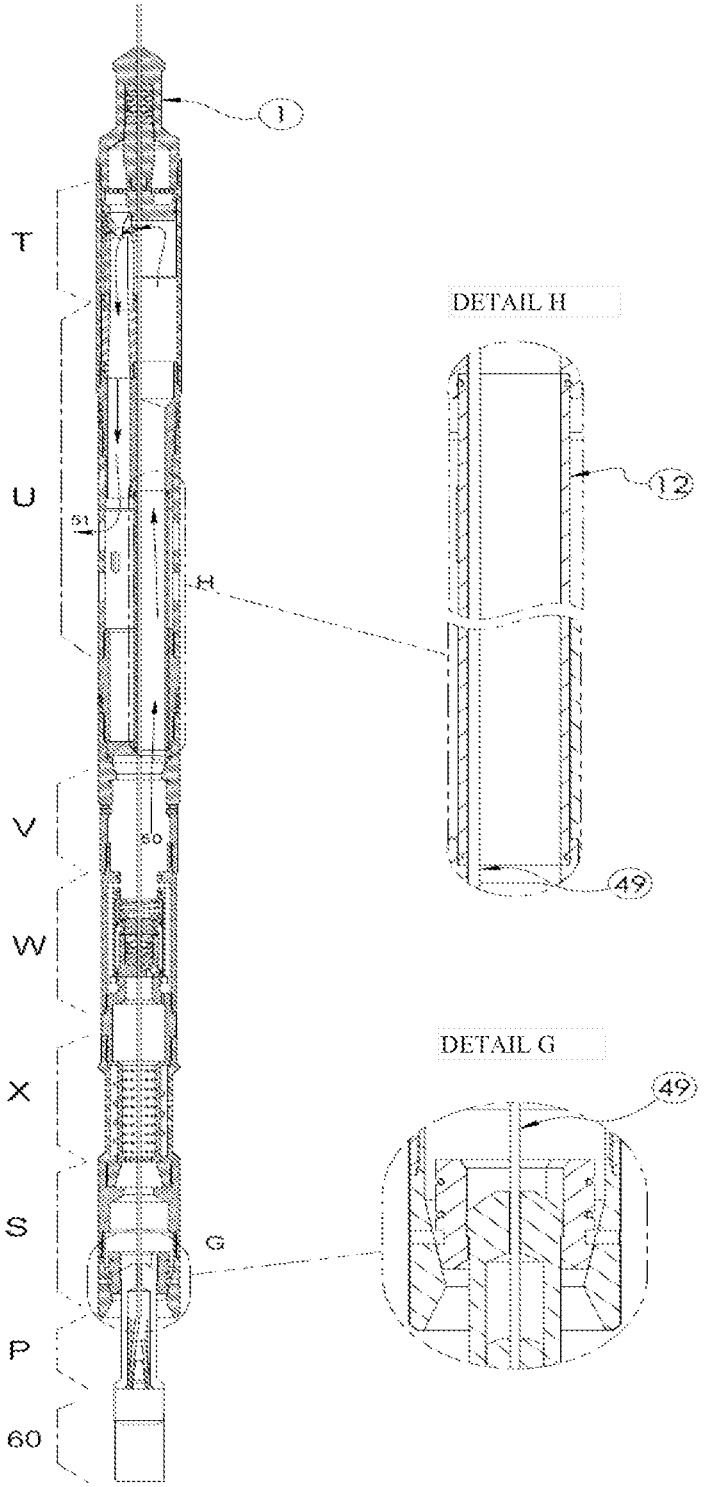

FIG. 4 represents the downhole jet pump assembly in longitudinal cut, with its most relevant subassemblies, such as: section 1 represents the fishing collar, where the first seal package (FIG. 3, detail B) and the threaded seal retainer are housed (FIG. 3.7), which is a metallic steel element that enters threaded to regulate the sealing pressure of the assembly, and in which, in one embodiment of the invention, six ports have been drilled to allow the entrance of the motive fluid; the T section, which is the largest diameter, where the nozzle and throat of the Venturi system are housed; and the final section of the suction pipe, with its components radially displaced to one side of the downhole jet pump shaft; section U, which houses the discharge to the annular space and a lower section of the suction section of the Venturi system; Section V, which houses a bypass system for equalization of the internal pressures in the downhole jet pump at the time of recovery to the surface; section W houses the body of the shut-off valve incorporated in this downhole jet pump for static pressure recording; section X houses the two filters for solids in the pump suction; section S represents the rod davit with the fishing head P engaged as shown in detail G. Detail H shows the suction pipe (12) enlarged in its internal area as it passes through the sliding sleeve section allowing an axial and laminar flow which avoids losses in pump efficiency.

Figure 5:
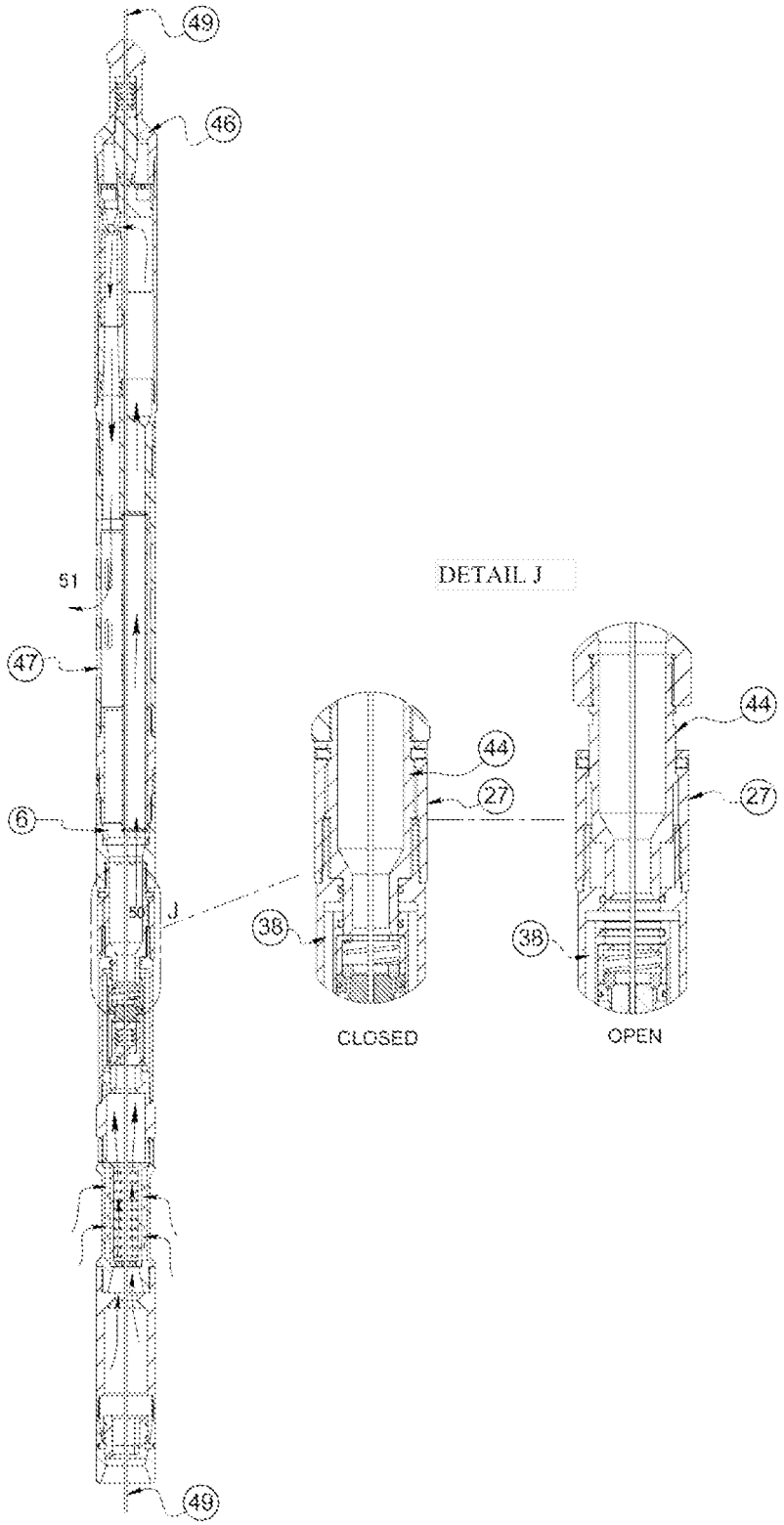

FIG. 5 shows the downhole jet pump assembly in longitudinal section with the concentric steel cable (49), excluding the representation at its lower end of the coupling with the string of MPLT recorders. Here we can see the suction flow paths (50) from the lower end of the pump (FIG. 4. S) and through the lower solids filters (FIG. 4 X), and the production flow path (51) of the downhole jet pump, highlighting its straight path, without curvatures, edges or angles, and details of the operation of the bypass valve. The upper end shows the motive fluid inlet gantries (46); the middle section shows the discharge gantries to the annular space (47) and the suction pipe housing (6). In the attached detail J, the bypass system (FIG. 4. V) is shown in its open and closed positions, with its main components, which are: a flow sleeve (27), the connector mandrel (44) and the gantries (38).

4. DETAILED DESCRIPTION OF THE INVENTION

The recovery of downhole variable logs requires specialized instrumentation that is moved to the depth of the reservoirs for analysis and decision making, either in dynamic or static conditions, to be later recovered and transferred to the surface where they will be interpreted by professionals. The main parameters required are: pressures, temperatures and flow rates of the fluids, whether water, oil or gas.

In artificial lift systems, reference is made to electro-submersible pumping that has a coupling system (downhole Y-shunt) for the purpose of real-time data logging while the pump is operating; not so for the hydraulic pumping system that uses a downhole jet pump for oil lifting, which has been a limitation in this system at the time of having such information available while the pump is operating.

Field production lifting by hydraulic pumps, using downhole jet pumps, known in the state of the technique, including the Jet Claw pump, which have been the subject of other patents worldwide, entails a substantial limitation for the use of well logging variables in static (i.e. in non-producing conditions) and dynamic (i.e. in producing conditions) conditions); Therefore, to solve the problem in this type of hydraulic pumping, the present invention internally modifies the entire pump, as shown in FIGS. 2, 3, 4 and 5, so that the highly sensitive measurement elements used to determine the characteristics of the well variables-whether for water, oil or mixed—can be retrieved by specialists at the surface, allowing the well's productive conditions to be established. This process must be carried out dynamically and statically, which is why the new design of the downhole jet pump and its elements have been modified to guarantee, on the one hand, safe work from the surface through the steel cable that handles the string with the logging instruments to position it at the different required depths of the well; and, on the other hand, the design must ensure the effectiveness of the work under safe control of pressures and flows at the time of recording measurements dynamically; and, finally, the appropriate design to ensure the safe displacement of the recorder elements during the recovery process of the same at the time of lifting the equipment. This is demonstrated in FIGS. 2, 3, 4 and 5, the details of which are given below.

The modified downhole jet pump (FIG. 2.59) of the present invention is a downhole assembly, which performs the function of lifting fluids from the bottom of the oil well to the surface while simultaneously performing logging of parameters such as pressure, temperature, flow, etc., at different depths in the production zone, for which the logger string (FIG. 4.60) is attached to a steel cable (FIG. 2.49) that runs through the modified jet-pump assembly concentric to the central shaft (FIG. 2.49, section A-A) of the same, with the purpose of allowing the steel cable driven from the surface to manipulate the well gauges when the pump is in oil production, to take measurements of the variables at times when the well is in a dynamic state; allowing the design of this new downhole jet pump to also take measurements of these variables in static conditions, that is, when the downhole jet pump is not lifting oil; but it is possible to take the required parameter data at different depths of the reservoir by moving the logging string from the surface with the steel cable that descends from the surface and that, crossing the downhole jet pump through two unique places where the sealing media are located, is coupled to the logging string in a safe way and without intermediate obstacles that hinder this operation.

At the upper end of the modified downhole jet pump assembly of the present invention, a fishing collar is incorporated (FIG. 4.1), inside which is housed a first seal package (FIG. 3 detail B) whose function is to support the operating pressure of the downhole jet pump and to isolate the passage of the steel cable inside the modified downhole jet pump, preventing the entry of the motive fluid that is driven from the surface through the production piping (FIG. 1*a*.56) and through the injection ports (FIG. 5.46) inside the downhole jet pump; also, in the lower part of this assembly, there is a second seal package (FIG. 3, detail D; FIG. 4 section W) that isolates the passage of the steel cable at the outlet of the modified downhole jet pump, below the Bypass system (FIG. 5 detail J), preventing the production fluid from communicating through the steel cable to the internal suction elements (FIG. 5.50).

As an integral part of the fishing collar (FIG. 2.1) a threaded seal retainer (FIG. 3.7) is incorporated, which regulates the sealing pressure of the wire rope (FIG. 3.49) and retains the upper seal assembly (FIG. 3 detail B) in place. The fishing collar (FIGS. 2.1) also has the function of hooking the downhole jet pump at the top with a cable unit in case tension is required for its retrieval to the surface. Another novel feature of this invention is a solid filter (FIG. 3.8) located at the inlet of the downhole jet pump, before the nozzle, which corresponds to the motive fluid that is injected from the surface to eliminate the adverse effect of well fluids that are often contaminated with solids that, when passing through the internal parts of the downhole jet pump, can clog the ducts causing a plugging and a loss of efficiency in the production of the well, putting at risk the flow and pressure measurements of the well.

The modified direct flow downhole jet pump (FIG. 2.59), uses the Venturi effect by means of a nozzle (FIG. 3.21 detail C) and a mixing tube or throat (FIG. 3.22 detail C) for the extraction of fluids from the well, by taking advantage of the potential energy of a motive fluid injected from the surface through the production tubing (FIG. 1*a*.56), which when exiting through the nozzle into the throat causes the production fluid (FIGS. 3.50 detail C, 4.50 and 5.50), from the lower end of the pump (FIG. 4. S) and through the solids filters (FIG. 4. X), with which it mixes in the throat (FIG. 3.22), being driven through the diffuser (FIG. 3.11) by the discharge path (FIG. 3.51) into the annular space (FIG. 1*a*.55), passing through the discharge ports (FIG. 5.47) of discharge pipe ports (FIG. 3.4) and a plurality of circulation ports (FIG. 1*b*.48) of the sliding sleeve (FIG. 1*b*.52) to bring it to the surface. This model of modified direct injection downhole jet pump uses the production tubing (FIG. 1*a*.56) for the motive fluid, and the annular space (FIG. 1*a*.55) to lift the mixture to the surface. This feature of the present invention is not limiting as it can also be applied to a reverse flow downhole jet pump.

Another innovation of the present invention is the discharge connector (FIG. 3.3) which incorporates in its interior a novel design of the discharge (FIG. 2.M section A-A) and suction (FIG. 2.N section A-A); both ducts, attached parallel to each other, of longitudinal routes without edges or angles or curvatures, and that when discharging the mixture of production and injection fluids into the annular space (FIG. 1*a*.55) in a direct way (FIG. 5.51), through the discharge ports (FIG. 5.47) of the discharge pipe ports (FIG. 3.4) and the circulation ports (FIG. 1*b*.48) of the sliding sleeve (FIG. 1*b*. 52), design features are obtained which improve the efficiency of the downhole jet pump of the present invention, and which are not found in the existing technical state.

The components of the downhole jet pump of the present invention, which include the nozzle (FIG. 3.21), throat (FIG. 3.22) and diffuser tube (FIG. 3.11), are housed inside the discharge connector (FIG. 3.3), which, in order to accommodate such components and comply with an optimum design, needs to be of a larger diameter than the inner diameter of the sliding sleeve (FIG. 2.52). This special design feature means that it is in this section that the modified downhole jet pump of the present invention is seated in the liner. Therefore, you then have specially designed housings to optimally accommodate and distribute the other component elements, resulting in additional unique features, as described below.

Continuing down towards the bottom of the well, another novel element is incorporated to the downhole jet pump of this invention, which intervenes when it is required to extract the pump towards the surface and consists of a bypass system [(FIG. 5, detail J) that is activated by hydraulic pressure injected from the annular space, which shears a plurality of safety pins (FIG. 3.28), releasing a connector mandrel (FIG. 3.44) that slides down and opens the circulation of fluids from the top of the pump towards the bottom of a reservoir (FIG. 3.44). 3, 28), releasing the connector mandrel (FIG. 3.44) that slides down and opens the circulation of fluids from the top of the pump to the bottom of the reservoir (FIG. 5, detail J), through the sliding sleeve (FIG. 3.27) and the gantries (FIG. 5.38), waiting a few minutes until the pressures equalize between these environments.

Continuing in the downward direction towards the well, a novel one-way bottom shut-off valve (FIG. 4.W) is incorporated, which when performing the function of closing the fluid passage from the top of the pump downwards, acts when pumping and production of the well is stopped, by displacing a sealing ring (FIG. 3.30) on which acts a spring (FIG. 3.33) that presses downward producing the metal-to-metal seal with a valve seat (FIG. 3.31), at which time the reservoir pressure is restored. This process is known as build-up for pressure recovery, and the shut-in is performed at this valve, and this reservoir pressure data is stored in the loggers in a logger string (FIG. 4.60). This novel shut-off valve is different from the state of the technique, in which, being of the ball type, the wireline has to move forcibly to one side of the valve.

Immediately downstream of the valve seat (FIG. 3.31) bypass, the lower seal assembly (FIG. 3, detail D) is incorporated inside the cable seal guard (FIG. 3.32). Thus, the cable is attached to the pump only at the two indicated points without the need of any other support or seal, maintaining the straight alignment and safe functionality of the cable holding the logging string.

On the other hand, a solid filtering system (FIG. 4. X) for solids in the production fluid leaving the reservoir is also incorporated downstream of the bottom shut-off valve (FIG. 4. W), consisting of an internal suction filter (FIG. 3.40) and an external suction filter (FIG. 3.42). This solid filtering system serves to protect the functionality of the shut-off valve when creating the metal-to-metal seal, and to ensure that neither the nozzle (FIG. 3.21) nor the nozzle retainer of the Venturi system are clogged by debris or other solids, problems that could lead to low production and even to extremes where there is no production contribution, in which case the downhole jet pump should be brought to the surface to perform a complete cleaning of its elements. The need to clean the filters is not frequent since the solids or rubber retention capacity is large and can assimilate a certain volume of solids, which can sometimes be a small rubber that gets between the seat and the seal and that affects more the closing of the valve than the production.

At the lower end of the downhole jet pump is incorporated a rod davit (FIG. 4. S) to which is attached a fishing accessory or fishing head (FIG. 4 P), which in its inner part secures the lower end of the steel cable (FIG. 4.49) with a hitch or knot system, and which allows to hook the string of recorders (FIG. 4.60), its diameter being the same as that of the rod davit, which is responsible for capturing the string of recorders (FIG. 4.60) that is at the bottom of the modified downhole jet pump assembly of the present invention, an activity that is performed when the downhole logging process has been concluded and it is required to retrieve all the test equipment to the surface. This system of capturing the string of gauges at the lower point of the modified downhole jet pump assembly avoids putting at risk the gauges that could come loose from the cable and fall to the bottom of the well, creating the need for a complex recovery given that, when the well has low pressure in its reservoir, it is necessary to recover the pump with wire line through a fishing process, for which the steel cable that crosses the pump at its upper part would have to be cut, resulting in the string of gauges coming loose and going to the bottom of the well. The modified downhole jet pump assembly of the present invention has this accessory for attachment to the recorder string (FIG. 4.60), which gives additional safety to the downhole logging operation.

5. METHOD OF OPERATION

The operation of obtaining the logs of the variables of an oil well using the modified downhole jet pump of the present invention is performed as follows:

The downhole jet pump of the present invention (FIG. 2.59) is completely assembled on the surface. The steel cable (FIG. 2.49) is introduced through the concentric hole in the fishing neck (FIG. 2.1), passing through the pump internally, in a concentric axial manner (FIG. 2.49 section A-A), passing through the upper seal assembly (FIG. 3, detail B) located in the fishing neck, through the lower seal assembly (FIG. 3 detail D), and being extracted by its lower end (FIG. 4. S) in a sufficient length of approximately 60 m, until it is coupled to the fishing head (FIG. 4. P) by means of a knot, to which in turn a logger string (FIG. 4.60) is coupled).

The assembly thus assembled, once the downhole jet pump that was in normal operation at the bottom of the oil well has been extracted, and without having to change or adapt the existing completion in the well, is introduced inside the production tubing, (FIG. 1.56) with the help of the steel cable that is coiled on a reel duly fixed in the ground. With the application of hydraulic pressure from the surface, the modified downhole jet pump (FIG. 1*b*. 59) of the present invention is driven downward until it is seated in its final position at the level of the sliding sleeve (FIG. 1*a*.52, FIG. 113.52 detail A). In this way, this assembly is safely inserted without danger of the wire rope getting tangled at the top or bottom of the assembly to its final position, due to the special design of the fishing collar (FIGS. 2.1 and 3.1), and the fact that at the bottom the wire rope is held in place by fitting the logger string (FIG. 4.60) to the fishing head (FIG. 4. P). Due to the larger diameter of the modified downhole jet pump at the discharge connector (FIG. 3.3), it is at the bottom of the discharge connector that the pump sits with the upper edge of the sliding sleeve.

Once the downhole jet pump is seated on the edge of the sliding sleeve, and this situation is verified at surface, first the fishing head (FIG. 4. P) and the logger string (FIG. 4.60) can be maneuvered and directed to different depths within the production sand sector of the well (FIG. 1*a*. 57), recording the first measurements with the well in static condition.

Next, the dynamic condition is initiated by injecting the motive flow through the head (FIG. 1*a*. 53) and the production tubing (FIG. 1*a*. 56), which, upon entering the interior of the downhole jet pump through the injection ports (FIG. 5.46), and passing through the nozzle (FIG. 3. Detail C. 21) towards the throat (FIG. 3. Detail C. 22), following the downward path indicated by the arrows (FIG. 5.51), causes a vacuum as it passes through this site, whose suction effect through the suction tube (FIG. 4. Detail H. 12) causes the opening of the shut-off valve (FIG. 4. W), allowing the extraction of the production fluid from inside this downhole jet pump assembly, following the upward path indicated by the arrows (FIG. 5.50), also evidenced in the lower part of FIG. 5 a lateral path of suction of the production fluid, through the filters represented in FIG. 4 section X. The dynamic condition is then established and logs are taken as programmed, directing the logger string by drive from the surface of the wireline (FIG. 2.49) to the desired depths within the production zone of the well (FIG. 1*a*.57).

Once the dynamic logging is finished, a new static logging is performed, for which the pumping of the motive fluid from the surface is suspended, so that the Venturi effect is suspended in the downhole jet pump, thus stopping pumping production fluid to the surface and causing the shut-off valve to close (FIG. 4. W), proceeding to the static parameter measurement logging.

Finally, for the extraction maneuvers of the downhole jet pump assembly and the recorder string, the pressures between the upper and lower parts of the pump are equalized by injecting hydraulic pressure from the annular space (FIG. 1*a*.55), which shears the safety pins (FIG. 3.28), releasing the connector mandrel (FIG. 3.44) that slides down and opens the circulation of fluids from the upper part (FIG. 5, detail J) of the pump to the bottom of the reservoir, through the sliding sleeve (FIG. 3.27), having to wait a few minutes until the pressures equalize between these environments. From the surface, by means of maneuvers with the steel cable (FIG. 5.49), the logger string (FIG. 4.60) is lifted with the fishing head (FIG. 4.P), until it enters the inner housing of the rod davit (FIG. 4. S). Under these conditions, the entire assembly can be pulled to the surface by maneuvering with the steel cable. If additional tension is required, the fishing collar (FIGS. 2.1 and 3.1) can be hooked with a cable unit for retrieval to the surface.

The invention claimed is:

1. A downhole jet pump wherein a steel cable is incorporated axially centered in relation to the pump, which crosses said pump longitudinally from a fishing collar to a rod davit, to be secured to a fishing head by means of a hitch or knot system, and where the steel cable is fastened and guided inside the pump by only two places, one location at a top level of the fishing collar passing through a first seal package, and another location at a bottom of the pump at a level of a well shut-off valve passing through a second seal package.

2. The pump claimed in claim 1, wherein the fishing collar:

a. houses within it the first seal package for sealing and securing the passage of the steel cable supporting a string of gauges and whose setting pressure and locked position are regulated by the action of a threaded seal retainer; and, b. and in the same, two injection ports are provided where a motive fluid activates the pump enters.

3. The jet pump according to claim 1, wherein it incorporates in the upper section next to the fishing collar, a discharge connector which has in its interior ducts for discharge of the motive fluid and for suction of oil; both ducts, parallel to each other, with longitudinal and axial runs in relation to a sliding sleeve, without edges, angles or bends, and which discharge a mixture of production and injection fluids directly into an annular space through a plurality of circulation ports of the sliding sleeve.

4. The jet pump according to claim 3, wherein at a lower end of the pump the pump has a fishing attachment that holds a string of measuring sensors by means of the fishing head, wherein an inner part it secures the steel cable with a knot.

5. The jet pump according to claim 4, wherein the fishing head is attached to a string of recorders, which are manipulated from the surface through the steel cable.

6. The jet pump according to claim 5, wherein the fishing head is housed in a space within the rod davit.

7. The pump according to claim 1, wherein mixing fluids resulting from a Venturi system, discharge directly into an annular space, through discharge pipe ports, located immediately downstream of the discharge connector, and through circulation ports to be lifted to the surface.

8. The pump according to claim 7, wherein the mixing fluids discharged from the Venturi system, discharge directly into the annular space, through the discharge pipe ports, located immediately downstream of a discharge connector, and through a sliding sleeve to be lifted to the surface.

9. The pump according to claim 8, wherein the discharge connector for the housing in the upper part of the pump of the aforementioned elements has a larger diameter in relation to the lower section of the pump which is inserted into the sliding sleeve.

10. The jet pump according to claim 9, wherein in a lower section of the pump there is a bypass system that is actuated by a hydraulic pressure injected from the annular space, when the pump is required to recover, which shears a plurality of safety pins, releasing a connector mandrel that slides down and opens a circulation of fluid from a top of the pump to a bottom of a reservoir, through the sliding sleeve, with the purpose of balancing a differential pressure allowing the pump to be safely extracted.

11. The jet pump according to claim 9, further comprising a solids filter at the site of entry of the motive fluid into the Venturi system.

12. The jet pump according to claim 11, wherein at a lower end of the pump the pump has a fishing attachment that holds a string of measuring sensors by means of the fishing head, wherein an inner part it secures the steel cable with a knot.

13. The pump claimed in claim 1, wherein elements of the jet pump that produce a Venturi effect of suction and discharge are positioned laterally in relation to the central axis of the pump and towards an upper part of the pump.

14. The jet pump according to claim 13, further comprising a solids filter at the site of entry of the motive fluid into the Venturi system.

15. The jet pump according to claim 1, wherein a well shut-off valve which is a one-way valve, to close a fluid passage from the top of the pump, displaces downward a sealing ring which is pressed by a spring, producing a metal-to-metal seal against a valve seat.

16. The jet pump claimed according to claim 15 wherein in the well shut-off valve a sealing ring in an "O" shape allows passage of the steel cable that supports a logger string and constitutes a second support and guide for the steel cable.

17. The jet pump according to the claim 1, wherein downstream of the shut-off valve it has a solid filtering system consisting of an internal suction filter and an external suction filter.

18. The jet pump according to claim 1, wherein at a lower end of the pump the pump has a fishing attachment that holds a string of measuring sensors by means of the fishing head, wherein an inner part of the fishing head secures the steel cable with a knot.

19. The jet pump according to claim 18, wherein the fishing head is attached to a string of recorders, which are manipulated from the surface through the steel cable.

20. The jet pump according to claim 1, wherein the fishing head is housed in a space within the rod davit.

* * * * *